US007243451B1

(12) United States Patent
Gutkin et al.

(10) Patent No.: US 7,243,451 B1
(45) Date of Patent: Jul. 17, 2007

(54) UNIVERSAL CYLINDER FOR REVOLVERS

(75) Inventors: Vladimir Gutkin, 94 Wintrop Shore Dr., Winthrop, MA (US) 02152-1202; Galina Gutkin, 94 Wintrop Shore Dr., Winthrop, MA (US) 02152

(73) Assignees: Vladimir Gutkin, Winthrop, MA (US); Galina Gutkin, Winthrop, MA (US)

( * ) Notice: Subject to any disclaimer, the term of this patent is extended or adjusted under 35 U.S.C. 154(b) by 0 days.

(21) Appl. No.: 11/398,801

(22) Filed: Apr. 6, 2006

(51) Int. Cl.
*F41C 3/14* (2006.01)

(52) U.S. Cl. ..... 42/59

(58) Field of Classification Search ..... 42/60, 42/61, 62, 39.5
See application file for complete search history.

(56) References Cited

U.S. PATENT DOCUMENTS 2,847,784 A * 8/1958 Dardick ..... 42/39.5
5,924,230 A * 7/1999 Hoke, Jr. ..... 42/60
6,931,774 B2 * 8/2005 Howell, Jr. ..... 42/61

* cited by examiner

*Primary Examiner*—Michelle Clement
*Assistant Examiner*—Benjamin P. Lee

(57) ABSTRACT

A universal cylinder of a revolver comprises a cylindrical case, this case has apertures for cartridges, executed in the case, and the open zone grooves of a lateral cylindrical surface for input and output cartridges.

4 Claims, 1 Drawing Sheet

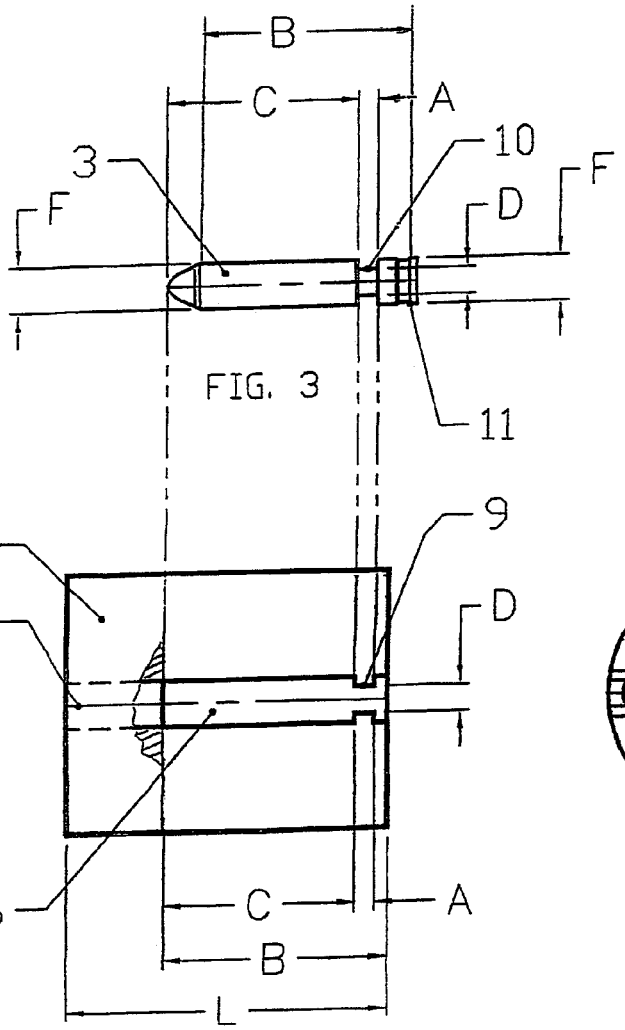
FIG. 3
FIG. 1
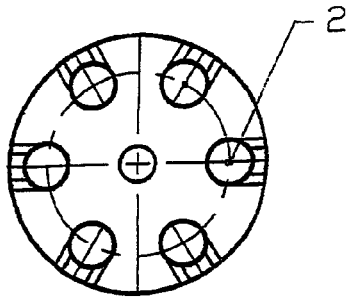
FIG. 2

UNIVERSAL CYLINDER FOR REVOLVERS

The present invention pertains to a cylinder for use with a revolver type firearm.

BACKGROUND TO THE INVENTION

Revolvers are very popular firearms particularly with law enforcement officers. They are convenient to use and economical to make and persons can be trained to use them relatively easily.

One of important elements of revolvers is the cylinder, which purpose is to hold cartridges ready to use (shooting). The cylinder has various quantities of apertures for cartridges, depending on the size (caliber) of a cartridge and diameter of the cylinder The cylinder gets filled up with cartridges from the back face party of the cylinder in forward direction. After use (shot) the shells get release from the cylinder in opposite direction i.e. from the front face party to the back face party of the cylinder. The operation of reloading the revolver perform manually and time consuming and inconvenient.

A major problem with revolvers however arises from the fact that they are slow and clumsy to reload in comparison with automatic pistols. This can be of very serious effect when a person using the firearm is under stress or under fire.

The purpose of the present invention is creation of the advanced—universal cylinder, allowing facilitating and simplifying process of filling of the cylinder by cartridges. The universal cylinder opens new perspective to the process of loading and unloading revolvers.

OBJECTS AND SUMMARY OF THE INVENTION

The specified purpose is reached because the advanced universal cylinder allows filling with cartridges and emptying the cylinder through a lateral face of the cylinder and allows to fill cylinder with cartridges and to empty the cylinder in the traditional way through the back face party, as it is done nowadays.

Filling by cartridges and emptying the cylinder from a lateral surface cylinder enables to simplify and reduce time of these operations, and to automate this process as well.

The universal cylinder of the revolver has the cylindrical body, through apertures for accommodation of the cartridges and the open zone (grooves) on a lateral surface of the cylinder for input and output of cartridges; grooves have a short site with the ledges displaced to a back face party of the cylinder. The length of the body of the cylinder is more than length of grooves on a lateral surface of the cylinder. The specified purpose is reached because of the new way of loading and unloading the universal cylinder of a revolver with cartridges through the open zone (grooves). It is more convenient and more quickly than to insert a cartridge into cylinder using a traditional method.

SHORT DESCRIPTION OF THE DRAWINGS

The figures are not drawn to any scale, as the specific dimensions of the cartridges will vary depending on the caliber of the cartridge.

FIG. 1 The universal cylinder from the party of a lateral surface of the cylinder; thus only one groove (holders) for an input and an output of the cartridges is shown; other grooves (holders) are similar.

FIG. 2 The universal cylinder from the back face party;

FIG. 3 A Cartridge for the universal cylinder under the present invention.

DESCRIPTION OF THE PREFERRED EMBODIMENT

The universal cylinder under the present invention is shown on FIG. 1 and FIG. 2. The cylinder has six through apertures 2 (the quantity of apertures depends on caliber of cartridges and diameter of the cylinder) with grooves 6 for an input and an output of cartridges 3 on a lateral surface of the cylinder 4.

Grooves 6 have a short site "A", with the ledges (a narrow portion) 9 (FIG. 1), displaced to the back face part of the cylinder.

The cartridge 3 (FIG. 3) should have a narrow site 10 (necking portion) size "A" on distance "C" from its front with diameter no more, than the size "D" between ledges 9 (FIG. 1) in order to pass narrower zone "A" between ledges 9 (FIG. 1) at an input in a groove of the cylinder and to lay down in the initial position.

The length of the cylinder "L" (FIG. 1) more than the length "B", part of the cylinder with grooves 6 and not less than the length of the cartridge. For an input of the cartridge in the cylinder it is necessary to bring the cartridge in the groove, and than to move the cartridge forward in final position. Thus, it is possible consistently to fill the cylinder with cartridges. To take out cartridges of the cylinder it is possible in return sequence. For this purpose it is necessary to move back the cartridge in the position when ledges of the cylinder coincide with zone "A" of the cartridge and then to remove cartridge from the cylinder with a direction from a lateral surface. In the final position, the cartridge cannot drop out by itself through grooves of the cylinder, as the final zone 11 of the cartridge has greater diameter, than the size "D" zone "A" between ledges 9 (FIG. 1) of the cylinder.

Use of the universal cylinder enables to simplify and reduce time of loading and unloading of a revolver and to automate this process and to see presence of cartridges in cylinder. It is to be understood that the present invention is not limited to the particular embodiment described above which has been given as a non-limiting example. Although the invention is illustrated and described with reference to a single preferred embodiment thereof, it is to be noted that it is no way limited to the disclosure of such a single embodiment, but is capable of numerous modifications within the scope of the appended claims.

What is claimed is:

1. A universal cylinder of a revolver comprising a cylindrical case, said case having apertures for cartridges, wherein said apertures comprise longitudinal grooves with openings along a outer circumferential surface area of said cylindrical case for loading said cartridges therethrough, and wherein said grooves comprise a necking portion substantially equal in diameter to a necking portion of said cartridge.

2. The universal cylinder of claim 1 wherein the length of the cylindrical case is greater than the length of said grooves on a lateral surface of the cylinder.

3. A method of loading a universal cylinder of a revolver comprising the steps of:

loading cartridges into apertures through longitudinal groove openings in a circumferential surface area of a cylindrical case, wherein the grooves comprise a necking portion substantially equal in diameter to a necking portion of said cartridges, wherein the length of the cylindrical case is greater than the length of said openings, and;

moving cartridges forward into a final position.

4. A method to load a universal cylinder of the revolver of claim 3 wherein the apertures are filled through a back face surface.

* * * * *